US005437144A

United States Patent [19]

Akiyama et al.

[11] Patent Number: 5,437,144

[45] Date of Patent: Aug. 1, 1995

[54] PACKAGING DEVICE

[75] Inventors: Heiemon Akiyama; Minoru Sato, both of Chiba, Japan

[73] Assignee: Tokyo Automatic Machinery Works, Ltd., Tokyo, Japan

[21] Appl. No.: 128,702

[22] Filed: Sep. 30, 1993

[30] Foreign Application Priority Data

| | | | |
|---|---|---|---|
| Oct. 30, 1992 | [JP] | Japan | 4-293389 |
| Oct. 30, 1992 | [JP] | Japan | 4-293391 |
| Dec. 24, 1992 | [JP] | Japan | 4-344583 |

[51] Int. Cl.[6] ..... B65B 11/20; B65B 63/02

[52] U.S. Cl. ..... 53/466; 53/436; 53/230; 53/528

[58] Field of Search ..... 53/466, 461, 436, 528, 53/231, 230, 228

[56] References Cited

U.S. PATENT DOCUMENTS

| | | | |
|---|---|---|---|
| 1,864,775 | 6/1932 | Straubel . | |
| 3,600,875 | 8/1971 | Buob et al. | 53/230 X |
| 3,991,542 | 11/1976 | White et al. | 53/228 X |
| 4,313,290 | 2/1982 | Furuya et al. | 53/230 |
| 4,586,632 | 5/1986 | Kuchler | 221/63 |
| 4,757,666 | 7/1988 | Janhonsen | 53/528 X |
| 4,805,383 | 2/1989 | Allwein | 53/528 |
| 4,953,344 | 9/1990 | Wallace | 53/528 |
| 5,092,236 | 3/1992 | Prim et al. | 53/528 |

FOREIGN PATENT DOCUMENTS

| | | |
|---|---|---|
| 1381075 | 10/1964 | France . |
| 3322867 | 12/1983 | Germany . |
| 314685 | 2/1991 | Japan . |
| 311124 | 3/1991 | Japan . |
| 311125 | 3/1991 | Japan . |
| 0390776 | 8/1965 | Switzerland . |
| 2061864 | 5/1981 | United Kingdom . |

*Primary Examiner*—James F. Coan

*Attorney, Agent, or Firm*—Sandler, Greenblum & Bernstein

[57] ABSTRACT

A packaging apparatus that compresses the contents in a vertical direction and tightly winds the contents. Upon the lowering of the elevator, compressive receiving plates project above the contents. The elevator is raised to hold the contents between the compressive receiving plates and the contents are compressed in the vertical direction. The winding guides approach each other, while the contents are being compressed. Both ends of the packaging sheet are connected by the fixing elements, and then the compressive receiving plates are pulled out.

19 Claims, 14 Drawing Sheets

B
B2
A4
C3
A5
13
B3
A6
6
6a
7
1
B4

PACKAGING DEVICE

BACKGROUND OF THE INVENTION

1. Field of the Invention

This invention relates to a wrapping and packaging device for use in covering substantially rectangular-shaped contents, which can be compressed in a vertical direction, such as piled-up items, with a packaging sheet such as craft paper. For example, the contents may be many piled-up papers, books, belt-like clothes, fabrics folded in a longitudinal direction or a zig-zag form, and many accumulated boxes. More particularly, this invention relates to a system in which substantially rectangular-shaped contents are placed above a packaging sheet supplied onto an elevator. The packaging sheet is folded in a substantial U-shape along the bottom surface and both opposing side surfaces of the contents at the packaging start position during descent of the elevator. Both ends of the packaging sheet are folded along the upper surface of the contents and wound on the surface.

2. Background and Material Information

As disclosed in Japanese Utility Model Publication No. 3-11125, there is provided a system in which a packaging sheet is supplied onto the elevator during its ascending operation. The contents are manually placed, at a predetermined position, on the packaging sheet after the elevator is stopped at its upper limit position. A switch is manually operated to cause the elevator to be lowered. Both ends of the packaging sheet are folded into a substantial U-shape, and overlapped along the upper surface of the contents. Thereafter, the contents are transported horizontally and a frictional rotating member abuts against one end of the folded packaging sheet, on the upper surface of the downstream end in the transporting direction, and the frictional rotation member is rotated. Thereby, one end of the packaging sheet is pushed back, under frictional resistance, in an direction opposite to the transporting direction, to fasten the sheet. At the same time, when the other end of the packaging sheet, folded on the upper surface, at the upstream side in the transporting direction, passes below the frictional rotating member, the lower end of the frictional rotating member, rotated by a motor, abuts against the other end of the packaging sheet. Thereby, the other end of the packaging sheet is forcibly pushed, under the frictional resistance of these two members, in the transporting direction and the packaging sheet is fastened. Thereafter, an adhering tape adheres to both ends of the packaging sheet to make a finished package without any looseness.

In addition, as disclosed in Japanese Patent Publication No. 3-14685, there is provided a device in which a packaging sheet is supplied onto the elevator during its ascent. After the elevator stops at its upper limit, the contents are manually placed at a predetermined position on a packaging sheet. A switch is manually operated, whereby the elevator is lowered to cause both ends of the packaging sheet to fold up into a substantial U-shape. The packaging sheet ends are overlapped along the upper surface of the contents, and its winding is completed. Subsequently, the wound contents are horizontally transported, from the elevator, to a discharging table by a transporting means. Both side flaps, at each of the feeding-out ends of the packaging sheet, are folded inwardly along the opened side surfaces of the contents. Thereafter, the upper flap of each of the extending ends is folded down along both side surfaces of the contents. Concurrently, the adhering tape, fed-out by a tape feeding-out mechanism, adheres to both overlapped side ends of the packaging sheet by an adhering mechanism, and is sealed. Then, the lower flap is folded along the outer side of the folded upper flap, and, the extreme ends of the outermost, overlapped lower flap are folded along the upper surface of the contents under an inward projection of a guide. The adhering tape, fed out by a tape feeding-out mechanism, adheres to the extreme end of the lower flap and the upper surface of the contents, by an adhering mechanism, and is sealed.

However, the prior art packaging devices described above, have some problems in that they do not function to compress the contents in a vertical direction, even if the packaging sheet can be tightened against the contents, because one end of the packaging sheet is moved, and fastened after winding of the packaging sheet around the contents. The packaging sheet may not be tightly wound, under a low fastening force, due to the fastening of the packaging sheet under a frictional resistance. The frictional resistance is generated by abutment between the lower end of the frictional rotating member and the packaging sheet. A low frictional resistance is caused by a narrow abutting area with the packaging sheet. In particular, when the contents are piled-up material, and can be compressed in a vertical direction, some clearances are produced between the contents and the packaging sheet because the packaged contents are compressed. This results in broken contents, and produces wrinkles in the packaging sheet.

In addition, the entire device is large due to the fact that the packaging start position and the packaging completing position are spaced apart in both vertical and horizontal directions. Furthermore, when the contents are mounted at the packaging start position by the manual operation of one worker, and the lowering of the packaged contents from the packaging completing position, are alternatively carried out, the amount of work is high and the processing may not be easily carried out. In view of the aforesaid circumstances, it is a first object of the present invention to tightly wind the contents of vertically compressed contents. A second object of the present invention is to provide the packaging start position and the packaging completing position as near as possible without delaying the packaging speed.

SUMMARY OF THE INVENTION

In order to solve the above-mentioned problems, the present invention includes a pair of winding guides arranged between the packaging sheet supplying position and the elevator in such a way that they may be reciprocated along the upper surface of the lowered contents, in a direction moving toward and away from each other. The ends of these winding guides are arranged opposing botch side surfaces of the contents. The elevator is lowered, compressive receiving plates are arranged between the winding guides and the upper surface of the lowered contents in such a way that they may be fed out or fed in on the rising or lowering passage of the elevator. When the compressive receiving plates are projected and opposed against the upper surface of the contents, the elevator is raised. At the same time, the winding guides are moved to approach each other, and both ends of the packaging sheet are connected by a fixing means.

In addition, preferably, there is provided transporting means for transporting the wound contents horizontally along the mounting surface of the lowered elevator, and the transported contents is raised and transported to the packaging completing position adjacent to the packaging start position by the elevator. There is provided an end folding means for folding each of the extended ends of the wound packaging sheet along the opened side surface of the contents. The folding operation occurs during the time ranging from the horizontal transportation of the contents by the transporting means to the ascending transportation by the elevator.

In accordance with the present invention, the compressive receiving plates project above the contents after the elevator is lowered. Thereafter, the elevator is raised to hold the contents B between the compressive receiving plates, the contents are compressed in a vertical direction, and the winding guides approach and move while the contents are being compressed. Both ends of the packaging sheet are connected by the fixing means and then the compressive receiving plates are pulled out.

After both ends of the packaging sheet are connected, the elevator is slightly lowered, the compression of the contents is loosened, and the compressive receiving plates are moved out of the raising or lowering passage under this loosened condition.

In addition, each of the sheet pressers abuts against the upper surface of the winding guide after the packaging sheet is folded in a substantial U-shape to hold both ends of the packaging sheet. Thereafter, these winding guides are moved in such a direction as they may approach each other along the upper surface of the lowered contents. Thereby, each of both ends of the packaging sheet are wound in a U-shape and closely contacted along the upper and lower surfaces and the inner ends of the winding guides. The packaging sheet is forcibly tensioned by these frictional resistances.

As the winding guides approach each other, the tension force applied to the packaging sheet increases due to frictional resistance with the winding guides. Thereby, the packaging sheet is pulled out from between the upper surfaces of the winding guides and the sheet pressers. The adhering surface of the adhering tape is adhered to the sheet pressers during this pulling-out operation. The packaging sheet is further forcibly tensioned after the pulling-out operation stops.

Then, the contents move and lower, from the packaging start position by the elevator, to between the spaced-apart winding guides. Thereby, after both ends of the packaging sheet are folded in a substantial U-shape. These winding guides are moved along the upper surface of the lowered contents so that they approach each other. Both ends of the packaging sheet are folded along the upper surface of the contents to complete the winding step. The wound contents are transported horizontally by the transporting means along the mounting surface of the lowered elevator. Each of the extended ends is folded by the folding means while the contents are raised and transported, by the elevator, toward the packaging completing position. The packaging sheet and the contents are transported in a substantially U-shape form. The adjoining packaging start position, and the packaging completing position, are arranged and approached at the same height position.

In addition, the packaging sheet is supplied to the packaging start position. Thereby, the part of the packaging sheet projecting from the contents is held while being bent upwardly along the guiding passage. The amount of the packaging sheet projecting from the contents, from the packaging start position to the packaging completing position, is short.

DETAILED DESCRIPTION OF THE PREFERRED EMBODIMENTS

Figure 1:
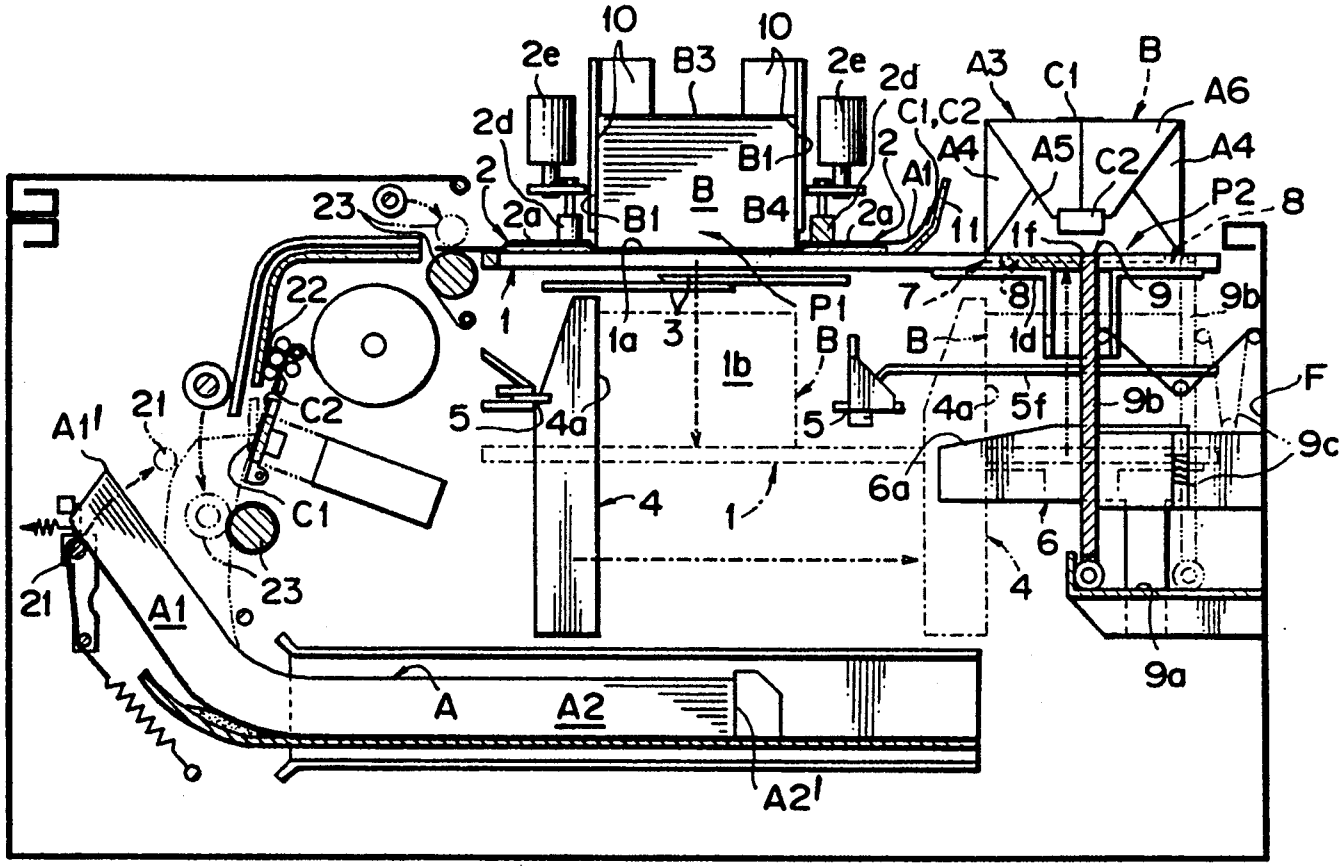
FIG. 1 is a longitudinal front elevational view in section for showing one preferred embodiment of the packaging device of the present invention with the packaging start time and the packaging completion time being concurrently shown.
Figure 2:
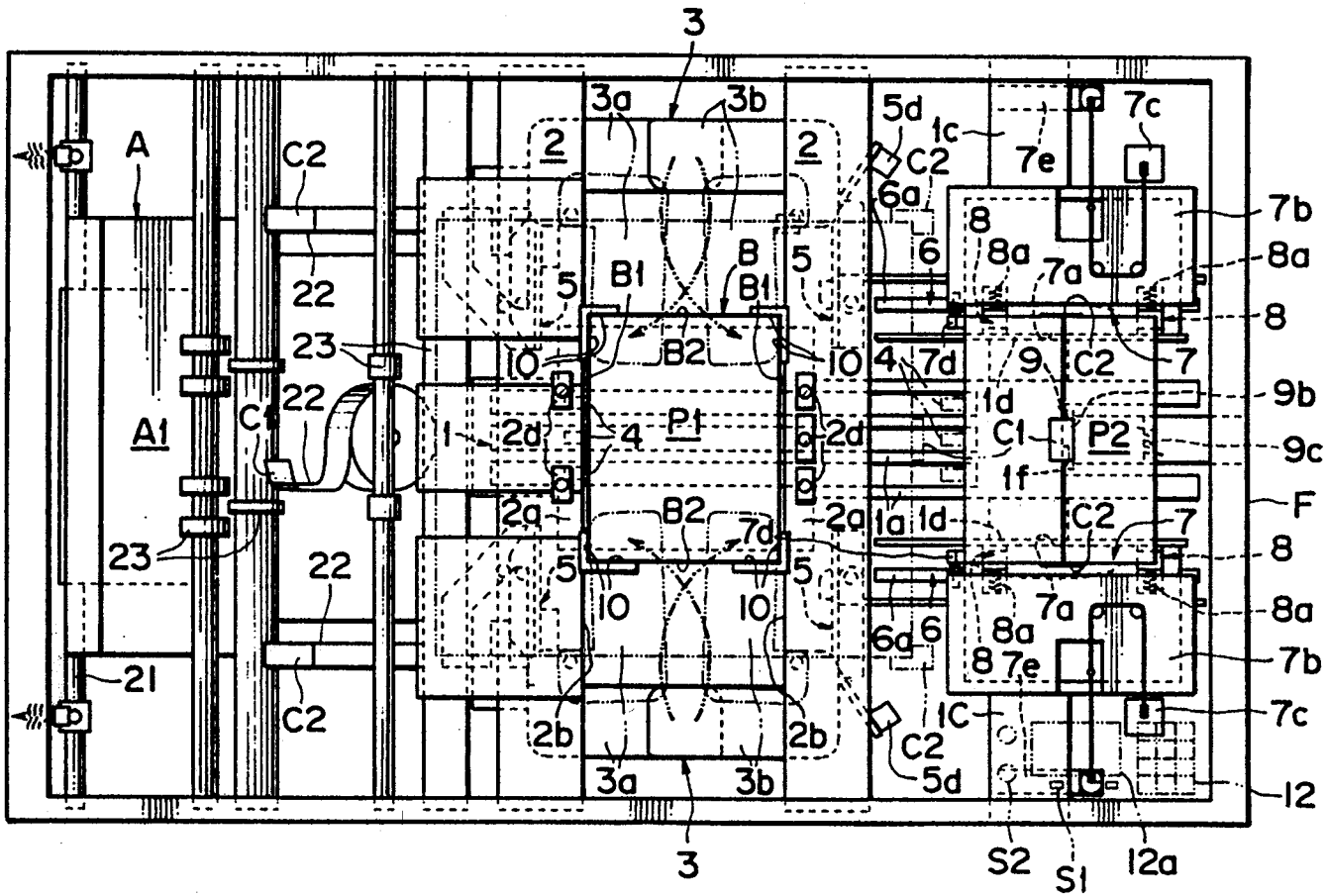
FIG. 2 is a cross sectional top plan view of FIG. 1.
Figure 3A:
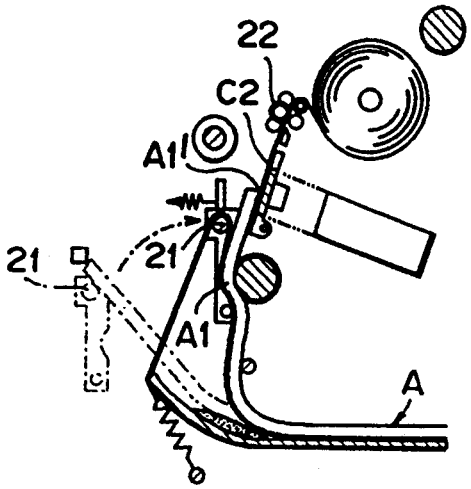
FIG. 3(*a*)–FIG. 3(*d*) are partial longitudinal front elevational views in section for showing the packaging sheet feeding-out steps in sequence.
Figure 3C:
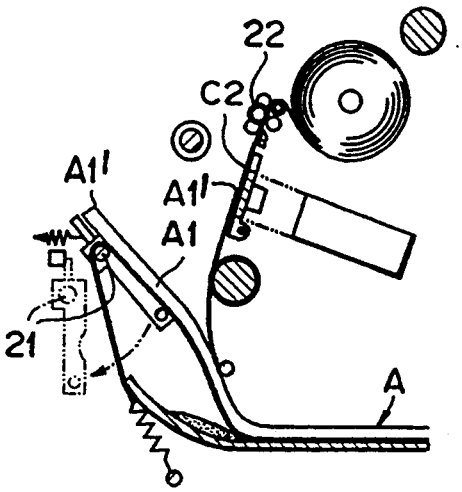
Figure 3B:
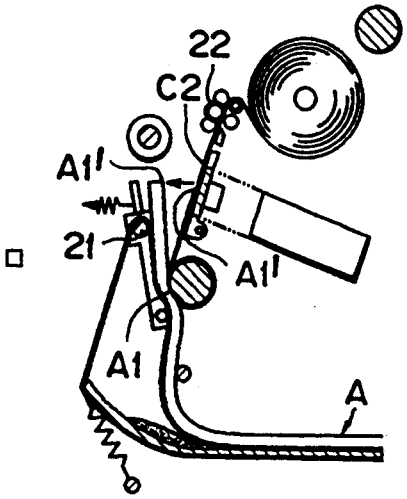
Figure 3D:
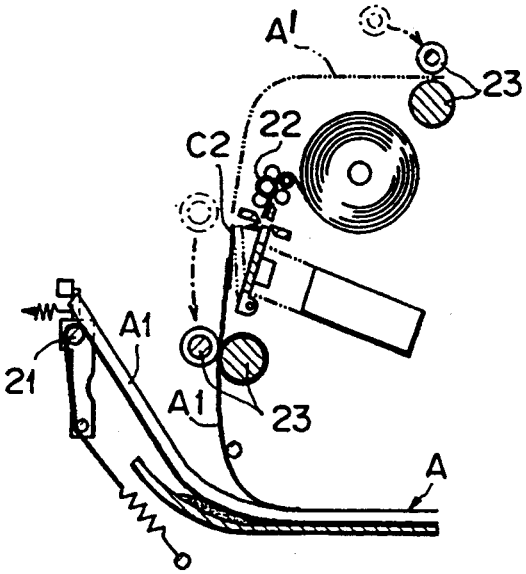
Figure 4A:
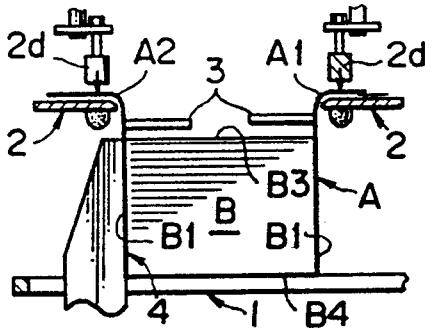
FIG. 4(*a*)–FIG. 4(*g*) are partial longitudinal front elevational views in section for showing the winding steps in sequence.
Figure 4B:
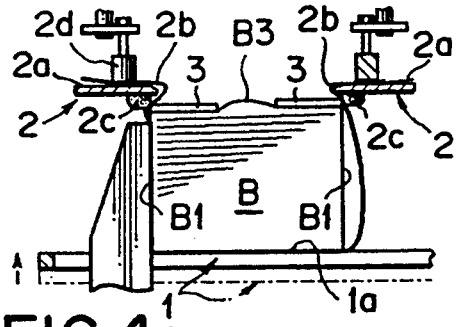
Figure 4C:
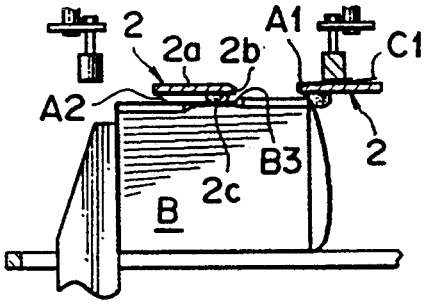
Figure 4D:
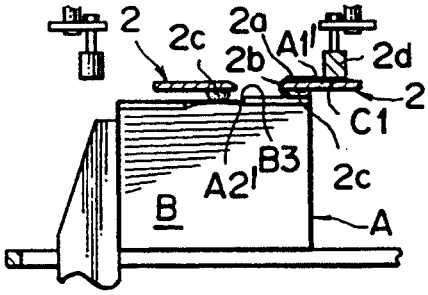
Figure 4E:
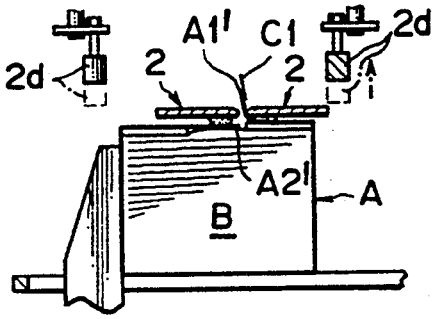
Figure 4F:
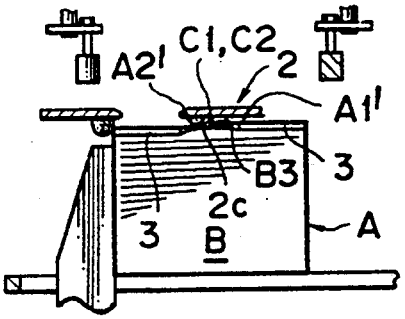
Figure 4G:
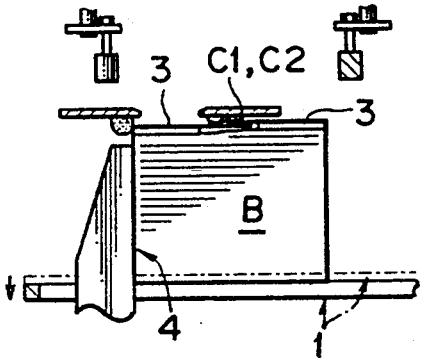

Referring now to the drawings, one preferred embodiment of the present invention will be described As shown in FIGS. 1 and 2, the preferred embodiment is constructed such that extreme ends A1 of accumulated packaging sheets A are bent upwardly in a slanted manner. The bent extreme ends A1 move in a bending direction by adhering means 21, as shown in FIG. 3. The extreme ends A1 forcibly contact adhering tapes C1, C2, C2, which are fed out from, and supported by, tape feeding-out means 22, 22, 22, acting as the fixing means. Thereby, each of the corresponding sealing positions, arranged at the central, right and left direction and end positions, of extreme end A1 of packaging sheet A, positioned at the downstream end in the accumulating direction are adhered and held by adhering tapes C1, C2, C2. Thereafter, extreme ends A1 of packaging sheets A move in a counter-bending direction, spaced apart from tape feeding-out mechanisms 22, 22, 22. A recovering force, in which packaging sheets A are returned in the counter-bending direction, is utilized to cause the entire extreme ends A1 of the other accumulated packaging sheets A to be forcibly pulled out from extreme end A1 of the downstream end packaging sheet A held by adhering tapes C1, C2, C2. The packaging sheet A, including adhering tapes Cl, C2, C2, is fed out toward packaging start position P1, through the inverse, L-shaped feeding-out passage A' and bent below by sheet feeding-out means 23. Thereby the sheets are supplied one-by-one between reference guides 10 and winding guides 2, 2.

The elevator 1 is constructed such that mounting surface 1*a*, on which bottom surface B4 of contents B is mounted, reciprocates in a vertical direction along raising or lowering passage 1*b*. The width of mounting surface 1*a*, in the sheet supplying direction, corresponding to a longitudinal direction of supplied packaging sheet A, is formed such that two maximum size pieces of contents B can be arranged side-by-side in the same direction. At the same time, the length of the mounting surface, in the right and left direction, crossing at a right angle horizontally, is formed so that the downstream side, in the sheet supplying direction, is shorter than that of the upstream side in the right and left direction, and substantially the same, or shorter, than the length of contents B, of the minimum size in the right and left direction. Arms 1*c*, 1*c*, projecting outside in the right and left direction, are cooperatively arranged at the lower side of the downstream side.

Suspending receiving tables 1*d*, 1*d* are vertically arranged at arms 1*c*, 1*c*, in such a way, that the tables may be reciprocated in the right and left direction. The upper surfaces of these suspending receiving tables 1*b*, 1*b* are arranged at the same height of that of the mounting surface 1*a*. The suspending receiving tables 1*d*, 1*d* cooperatively relate to supporting frames 7*b*, 7*b* of folding guides 7, 7, with connecting pieces 1*e*, 1*e*. The upper surfaces of suspending receiving tables 1*b*, 1*b* abut and are supported, near the right and left ends of the bottom surface B4 of contents B, in correspondence with the variation in the length size of contents B. The driving part, such as a stepping motor, is cooperatively arranged at arms 1*c*, 1*c*, and the mounting surface 1*a*, the arms and mounting surface are raised or lowered by the driving part.

The driving part for elevator 1 is controlled by the control part. The mounting surface 1*a* is initially raised to its upper limit just after packaging sheet A is supplied, and approaches winding guides 2, 2. Contents B are placed on packaging sheet A, and just after sheet pressers 2*d* move away from upper surfaces 2*a*, 2*a* of winding guides 2, 2, upper surface B3 of contents B lowers down to the lower limit position below winding guides 2, 2 and compressive receiving plates 3, 3. Subsequently, mounting surface 1*a* is slightly raised one or more times until upper surface B3 of contents B forcibly contacts compressive receiving plates 3, 3. The mounting surface 1*a* is slightly lowered after downstream end winding guide 2 projects up to the central upper positions of compressive receiving plates 3, 3. The lateral folding guides 5 later raise or lower mounting surface 1*a* and suspending receiving tables 1*d*, 1*d*, without any relation to the height of contents B. In this way, the guides oppositely face against the desired height positions of both side flaps A4. Upon completion of the advancing movement of pusher 6, the next packaging sheet A is supplied to the packaging start position P1 and raised up to its upper limit position and returned to its initial state.

The winding guides 2, 2 are constructed such that their upper surfaces 2*a*, 2*a* are substantially horizontal. Opposing ends 2*b*, 2*b* are formed into plates parallel with both side surfaces B1, B1 of lowered contents B in the sheet supplying direction. The length in the right and left direction is made longer than the length of maximum size contents B. The resilient members of 2*c*, 2*c*, such as sponges, or leaf springs, are fixed to their lower surfaces. They are arranged in such a manner that they may be reciprocated vertically and in the sheet supplying direction along upper surface B3 of lowered contents B. The driving part, such as a stepping motor, is cooperatively arranged to each of them, and they may be moved up and down and alternatively reciprocated under these driving parts.

The driving part for winding guides 2, 2 is controlled by the control part in the same manner as that of the driving part for elevator 1. The inner ends 2*b*, 2*b* are delayed in substantially the same vertical plane as both side surfaces B1, B1, of contents B while they are moved slightly upwardly, as elevator 1 rises to its upper limit position, just after packaging sheet A is supplied. Inner ends 2*b*, 2*b* project by a predetermined amount in a direction approaching each other, just after elevator 1 is lowered to its lower limit position under the slight downward movement of elevator 1. The winding guide 2, arranged at the upstream side in the sheet supplying direction, projects, by a desired amount, just after elevator 1 is slightly raised. The upper surface B3, of contents B, press contacts the compressive receiving plates 3, 3.

Then, winding guide 2, arranged at the downstream side projects by a predetermined amount. One, or a plurality, of projections are carried out, with a slight delay, from the above-mentioned operation. The winding guide 2, at the upstream end, projects to the central upper position of compressive receiving plates 3, 3, and approaches winding guide 2 at the downstream side. Upon completion of this approaching operation, winding guide 2, at the upstream side, moves in the counter sheet supplying direction. Concurrent with this operation, winding guide 2, at the downstream end, projects to the central upper position of compressive receiving plates 3, 3. The winding guides 2, 2 move horizontally toward the downstream side concurrently with the supplying of the next packaging sheet A to the packaging start position P1. Thereafter, upon completion of supplying of the next packaging sheet A, each of winding guides 2, 2 returns and moves horizontally. At the same time, they move slightly upward as elevator 1 rises, and they return to their initial state.

In addition, upper surfaces 2*a*, 2*a* of winding guides 2, 2 are provided with sheet pressers 2*d*, comprised of weights, so that they may move in the vertical direction. These sheet pressers 2*d* are arranged so as not to interfere with the passing position of adhering tape Cl, adhered in advance to packaging sheet A. The sheet pressers 2*d* are arranged on surface 2*a* of downstream side winding guide 2, so as not to interfere with the passing position of adhering tape Cl, adhered in advance. At the same time, a superior peeling sheet is fixed to the bottom surface, as required. Each of sheet pressers 2*d* is cooperatively engaged with driving parts 2*e*, 2*e*, such as solenoids, arranged above them.

The sheet pressers 2*d* are moved up and down by these driving parts 2*e*, 2*e*, and move toward and away from upper surfaces 2*a*, 2*a* of winding guides 2, 2.

The driving parts 2*e*, 2*e*, for sheet pressers 2*d*, are controlled by the control part. The sheet pressers 2*d* move and press contact upper surfaces 2*a*, 2*a* of winding guides 2, 2 during the initial state, just after packaging sheet A is supplied. The sheet pressers 2*d* move upwardly after the operation of the packaging start switch S2, and move away from winding guides 2, 2. The sheet pressers 2*d* move downwardly just after elevator 1 lowers to its lower limit position, and press contacts upper surfaces 2*a*, 2*a* of winding guides 2, 2. The sheet pressers 2*d* move upwardly upon completion of the approaching of winding guides 2, 2. Then, sheet pressers 2*d* move downwardly after the next packaging sheet A is supplied to the packaging start position P1, and return back to their initial state.

The compressive receiving plates 3, 3 are coated on their upper surfaces with a non-adhering coating, such as silicon coating. The compressive receiving plates 3, 3 are arranged reciprocally so that they are directed in the right and left direction from outside raising or lowering passage 1*b* of elevator 1, between winding guides 2, 2 and upper surface B3 of lowered contents B. At the same time, the width in the sheet supplying direction, when projected into at least the raising or lowering passage 1*b*, is formed to be the same as the width of contents B in the sheet supplying direction. Both side ends, in each of the sheet supplying directions, are arranged just above both side ends of upper surface B3 of contents B in the sheet supplying direction. The driving part, such as a stepping motor, is cooperatively arranged with these compressive receiving plates 3, 3, and each of them moves in the right and left direction by these driving parts.

The driving part, for compressive receiving plates 3, 3, is controlled in its operations by the control part. The compressive receiving plates 3, 3 are delayed outside of raising or lowering passage 1*b* of elevator 1 so as not to interfere with the lowering of packaging sheet A, and contents B, under the operation of elevator 1, to the initial state, just after packaging sheet A is supplied. The plates 3, 3 project out of the lowered contents B just after the packaging operation is started and elevator 1 is lowered. The plates 3, 3 engage the right and left ends of upper surface B3 of contents B. Winding guides 2, 2 are approached, and just after the elevator 1 is slightly lowered, they return and move out of raising or lowering passage 1*b* of elevator 1 from above contents B and return to their initial states.

In the preferred embodiment, each of compressive receiving plates 3 is divided into two segments in the sheet supplying direction, and arranged in parallel in the vertical direction. Base ends positioned outside of the right and left direction of these divided plates 3*a*, 3*b*, and located out of the dividing direction, are cooperatively related to the rotary driving part such, as a stepping motor, rotatably supported in a horizontal direction. Thereby, divided plates 3*a*, 3*b* overlap, while delayed, and rotate by 90° , from this state, around the base ends of divided plates 3*a*, 3*b*, toward raising or lowering passage 1*b* of elevator 1. The extreme ends of divided parts 3*a*, 3*b* are projected in a substantially horizontal direction, resulting in that compressive receiving plates 3, 3 are compactly arranged in the right and left direction.

At the position opposing side surface B1, at the upstream end in the sheet supplying direction of contents B lowered and transported by elevator 1, transporting means 4, for horizontally transporting lowered contents B in the sheet supplying direction, along the mounting surface 1*a* of lowered elevator 1, is arranged. The packaging completing position P2 is arranged adjacent to packaging start position P1, above contents B which are horizontally transported by transporting means 4. An end folding means is provided for folding each of extending ends A3, A3 of the wound packaging sheet A along opened side surface B2, B2 of contents B. This occurs during the time ranging from the horizontal transportation of contents B by transporting means 4, to the rising transportation of contents B to the packaging completing position P2 by elevator 1.

The transporting means 4 passes vertically through the mounting surface 1*a* of elevator 1, and is arranged in the sheet supplying direction in such a manner that it may be reciprocated. The upper end of the vertical transferring surface 4*a* is arranged below compressive receiving plates 3, 3, and at the same time, the driving part such as a stepping motor, is arranged. Thereby transporting surface 4*a* is reciprocated by these driving parts.

The driving part for transporting means 4 is controlled in its operation by the control part. The transporting surface 4*a* is delayed on the same vertical surface as the opposed upstream side surface B1 of contents B. Advancing movement of transporting surface 4*a* starts substantially concurrent with the advancing movement of upstream side lateral folding guides 5, 5. The transporting surface stops at the position where downstream side surface B1 of contents B abut against abutting portions 5*a*, 5*a* of downstream side lateral folding guides 5, 5. The upstream side lateral folding guides 5, 5 advance up to the desired positions of the opened side surfaces B2, B2 of contents B. Then, transporting surface 4*a* advances again at the same speed. It stops where it has advanced to the downstream side from the arranging positions of downstream side lateral folding guides 5, 5. It retracts toward the upstream side in the middle of the raising operation of elevator 1, or just after completion of the raising operation, and returns to its initial state.

The folding means is constructed such that lateral folding guides 5 abut against both side flaps A4 of extending ends A3, A3, during the horizontal transportation of contents B, by transporting means 4, and fold each of the side flaps along the opened side surfaces B2, B2 of contents B, and upper folding guides 6, 6, abut against lower flaps A5, A5, and fold them up along the opened side surfaces B2, B2 of contents B, these folding guides are arranged in sequence. The folding guides 7, 7 are arranged above upper folding guides 6, 6, and opposed against them, while they abut against each of the opened side surfaces B2, B2 of contents B, raised by elevator 1, in such a manner that they may project out along bottom surface B4, or upper surface B3, of contents B.

Only two lateral guides 5, positioned below winding guides 2, 2, and located at the upstream side in the sheet supplying direction, above contents B, on the same planes as those of the opened surfaces B2, B2 of the wound contents B, and oppositely against the intermediate vertical position of both side flaps A4 of extending ends A3, A3, are arranged in such a manner that they may be reciprocated in the sheet supplying direction. At the same time, the two lateral folding guides located at the downstream end from contents B are immovably arranged in the sheet supplying direction. Each of the lateral intermediate positions is rotatably supported in the folding directions of side flaps A4. Abutting portions 5*a*, opposed substantially parallel in relation to closed side surfaces B1, B1, which are initially spaced apart from contents B, are formed at one half part of the linear surface opposed against contents B. The other half part of the inner surface is formed with folding portions 5*b* opposed substantially parallel in relation against side flaps A4 which were initially spaced apart from contents B.

In addition, lateral folding guides 5 lower the folding portions 5*b*, by a predetermined height, toward lower flaps A5, A5, as each of the inner surface intermediate portions is rotated by ¼ rotation, while rubbing the four corners of side surfaces B1, B1, B2, B2, of contents B, when abutting portions 5*a*, and side flaps A4, abut each other. When the length extending from each of ends A3 is longer than a half of the width of each of opened side surfaces B2, elevator 1 and upper folding guides 6, 6 are lowered upon completion of the winding stage by a predetermined height substantially corresponding to the lowering amount of each of folding portions 5*b*. In turn, when the length extending from each of ends A3 is shorter than a half of the width of each of opened side surfaces B2, elevator 1 and upper folding guides 6, 6 are raised by a predetermined height so that the lower ends of lowered folding portions 5*b* reach up to bottom surface B4 of contents B.

The upstream side lateral folding guides 5, 5 are cooperatively provided with the driving parts, such as stepping motors. These driving parts are controlled in their operations by the control part. The abutting portions 5*a*, 5*a*, and folding portions 5*b*, 5*b*, are delayed at a position that does not interfere with the lowering operation of packaging sheet A and contents B, caused by elevator 1. The abutting portions 5*a*, 5*a* move in the same direction, substantially concurrent with the advancing movement of transporting means 4. They abut against the closed upstream side surface B1 of contents B causing folding portions 5*b*, 5*b* to rotate. They advance and stop at the position approaching the rotated downstream lateral folding guides 5, 5. They return to the upstream side upon completion of transportation of contents B by transporting means 4. Thereafter, they return in the middle of the retracting operation, and abut and engage with projections 5*c*, 5*c*. They forcibly rotate in the reverse direction against the folding direction and returned to their initial states.

The downstream side lateral folding guides 5, 5 include fixed and arranged temporary holding portions 5*d*, 5*d*, such as permanent magnets or electromagnets. They are arranged near downstream side lateral folding guides 5, 5, to cause the abutting portions 5*a*, 5*a* to be delayed substantially parallel with the closed downstream side surface B1 of contents B, transported by transporting means 4. Inclined cam surfaces 5*e*, 5*e* are formed at the lower ends of abutting portions 5*b*, 5*b*. The inclined cam surfaces 5*e*, 5*e* rotate toward the folding direction, as side flaps A4, A4 abut, and upper inclined sides 6*a*, 6*a* of the ascending upper folding guides 6, 6, subsequently abut and engage. Thereby, these lateral folding guides 5, 5 forcibly rotate in a reverse direction against the folding direction and return to their initial states.

In addition, when the vertical height of contents B is high, and pressing rods 5*f*, 5*f* are laterally arranged in a substantially horizontal direction over the arranging positions of upper folding guides 6, 6 from the rotating supporting portions for the downstream side lateral folding guides 5, 5, a clearance enables upper folding guides 6, 6 to pass, when formed, between pressing rods 5*f*, 5*f* and opened side surfaces B2, B2 of contents B. These pressing rods 5*f*, 5*f* abut against folded side flaps A4. Thereby, folded side flaps A4 are held by upper folding guides 6, 6 until the folding-up of lower flaps A5, A5 is completed.

The upper folding guides 6, 6 are vertically arranged in the same horizontal plane as the opened side surfaces B2, B2 of the wound contents B, and approached at the downstream end from the delayed position of the downstream side lateral folding guides 5, 5. Upper inclined sides 6*a*, 6*a*, opposing against the lower flaps A5, A5, are formed at the upper ends and supported so as to be movable in a vertical direction. The upper inclined sides 6*a*, 6*a* are adjusted and moved slightly higher than mounting surface 1*a*, during its lowering operation, without any relation to the amount of elevator 1 is lowered. Upon completion of the advancing movement of transporting means 4, they rise along the opened side surfaces B2, B2 of contents B, abut against lower flaps A5, A5, transported by transporting means 4, fold up along the opened side surfaces B2, B2, and further rise at the same speed when elevator 1 is raised.

The folding guides 7, 7 are constructed such that supporting frames 7*b*, 7*b* are arranged above the upper folding guides 6, 6, in such a manner that they may be adjusted and moved in the right and left direction in correspondence with the size variation of the length size of the contents B. Each of inner ends 7*a*, 7*a* is supported at supporting frames 7*b*, 7*b* in such a manner that they may be reciprocated in the right and left direction. The weights 7*c*, 7*c* apply a specified pressure in the direction for moving inner ends 7*a*, 7*a* toward each other. Stoppers 7*d*, 7*d* prevent the projections of inner ends 7*a*, 7*a*, from abutting against the upper surface B3 of contents B. The raising of elevator 1 releases its engagement and enables the projections of inner ends 7*a*, 7*a* and recovering means 7*e*, 7*e*, to move the projected inner ends 7*a*, 7*a* in the reverse direction and engage with the cooperatively arranged stoppers 7*d*, 7*d*.

The weights 7*c*, 7*c* cooperatively relate to inner ends 7*a*, 7*a* through a line material, such as a wire. The line material, suspended through rollers, to freely rotate at supporting frames 7*b*, 7*b* and inner ends 7*a*, 7*a*, are always pressed by the weights in the direction in which they move toward each other.

The stoppers 7*d*, 7*d* are arranged in the middle of the raising operation of contents B, caused by elevator 1, in respect to supporting frames 7*b*, 7*b*, and can be moved in the vertical direction to move toward and away from inner ends 7*a*, 7*a*. They always press in a direction abutting against inner ends 7*a*, 7*a* by a resilient member such as a spring. The right and left ends of upper surface B3 of raising contents B abut against stoppers 7*d*, 7*d*, and they move in a releasing direction moved away from inner ends 7*a*, 7*a*.

The recovering means 7*e*, 7*e* during the lowering of elevator 1, start to operate by weights 7*c*, 7*c*. This occurs upon completion of the projection of inner ends 7*a*, 7*a*, or by the retracting power of transporting means 4.

In the case of the preferred embodiment, inner ends 7*a*, 7*a* cooperatively relate to arms 1*c*, 1*c*, which project in the right and left direction, from the lower part of elevator 1, by the resilient material, such as spring or line material such as a wire. After elevator 1 is lowered from the upper limit position to the predetermined height position, the inner ends 7*a*, 7*a* move away from each other, and return to their initial states.

In addition, the supporting means resiliently project along bottom surface B4 of contents B, raised by elevator 1, and near folding guides 7, 7. The supporting means comprise, latches 8, having a small projection from supporting frames 7*b*, 7*b*, of folding guides 7, 7, toward the right and left ends of bottom surface B4. The latches 8 are projected by resilient members 8*a*; such as springs. A latch 9, having a large projection, fed in or fed out of a recess if, at the downstream end of the mounting surface 1*a* of elevator 1, projects toward the substantially central part of bottom surface B4. The upper end surfaces of latches 8 and 9 are arranged in substantially the same height position as that of the upper surfaces of folding guides 7, 7. Thereby, bottom surface B4 of contents B is supported by the projections.

The latch 9, having a large projection, is constructed such that a rising piece 9*b*, is reciprocally fed in a sheet supplying direction, on base table 9*a*, disposed below the lower limit position of mounting surface 1*a*. The rising piece 9*b* is always pressed toward the upstream side, through resilient member 9*c*, such as a spring, between rising piece 9*b* and frame F.

In turn, at the packaging start position P1, reference guides 10, opposing against each of either both side surfaces B1, B1 opposing against, in the sheet supplying direction of contents B, and at least the remaining side surfaces B2, B2 are arranged spaced apart and above elevator 1. When contents B are placed at the packaging start position P1, enclosed by these members, side surfaces B1, B1, B2, B2 of contents B abut against each of reference guides 10 and the position is set. At the same time, a guiding passage 11, for upwardly bending and holding extreme end A1 of packaging sheet A having adhering tapes C1, C2, C2 adhered thereto, is arranged between packaging start position P1 and packaging completing position P2.

In addition, near packaging start position P1 and packaging completing position P2 are arranged an inputting means 12, for example, for inputting an outer shape and an outer size of packaging sheet A and contents B, a sheet feeding-out start switch S1 and packaging start switch S2. The inputting means 12 communicates with sheet feeding-out means 23 through the control part. The inputting is variably performed every time the size of the! outer shape and size of packaging sheet A and contents B are changed. The driving part, for sheet feeding-out means 23, is controlled in its operation in response to the result of a calculation at the control part. Thereby, extreme end A1′ of packaged sheet A, wound and overlapped without having any relation to the variation in size, is disposed at the central position in the sheet supplying direction of upper surface B3 of contents B. The feeding-out amount of the packaging sheet is adjusted in such a manner that the winding completion form becomes constant, and at the same time, the inputted value is displayed by a displaying part 12*a* such as a CRT.

The sheet feeding-out start switch S1 and packaging start switch S2 communicate with the driving part for tape feeding-out means 22, 22, 22, the driving part for adhering means 21, the driving part for sheet feeding-out means 23, the driving part for elevator 1, the driving part for winding guides 2, 2, the driving part for compressive receiving plates 3, 3, the driving part for transporting means 4, the driving part for lateral folding guides 5 and the driving part for upper folding guides 6, 6, through the control part. The sheet feeding-out start switch S1 is manually operated. Thereby, the driving part for tape feeding-out means 22, 22, 22, the driving part for adhering means 21, and the driving part for sheet feeding-out means 23 are operated in sequence and one packaging sheet A is supplied to packaging start position P1.

Under this condition, contents B are placed at packaging start position P1, packaging start switch S2 is manually operated, and the driving part for elevator 1, the driving part for winding guides 2, 2, the driving part for compressive receiving plates 3, 3, the driving part for transporting means 4, the driving part for lateral folding guides 5, and the driving part for upper folding guides 6, 6 are operated in sequence. The packaging of contents B is started, and concurrently with this starting operation, the driving part for tape feeding-out means 22, 22, 22, the driving part for adhering means 21, and the driving part for sheet feeding-out means 23 are operated in sequence, and next packaging sheet A is supplied to packaging start position P1.

At first, a sheet supplying start switch S1 is manually operated to cause one packaging sheet A having adhering tapes Cl, C2, C2, partially projected and adhered thereto, to be supplied to packaging start position P1 along feeding-out passage A′. Its extreme end A1 is bent upwardly along guiding passage 11, as shown in FIG. 1, and held there. In the case that a longitudinal size of packaging sheet A is long, its terminal end portion A2 is bent downwardly along feeding-out passage A′ and held there, so that an exclusive space for packaging sheet A at packaging start position P1 can be minimized in the sheet supplying direction.

Upon completion of the transportation of packaging sheet A, sheet pressers 2*d* move downwardly to hold packaging sheet A, supplied between upper surfaces 2*a*, 2*a* of winding guides 2, 2, as shown in FIG. 1, and a positional displacement of packaging sheet A is prevented. Under this condition, if contents B are position set on packaging sheet A, packaging sheet A is bent due to the weight of contents B and lower surface B4 of contents B abuts against mounting surface 1*a* of elevator 1.

Subsequently, upon manual operation of packaging start switch S2, sheet pressers 2*d* move upwardly, the holding of packaging sheet A is released, and elevator 1 starts to lower. Thereby, packaging sheet A is bent in a substantial U-shape along bottom surface B4 of contents B and both side surfaces B1, B1, as shown in FIG. 4 (*a*). Upon stopping the lowering of elevator 1, sheet pressers 2*d* move downwardly to hold packaging sheet A between upper surfaces 1*a*, 1*a* and winding guides 2, 2, and substantially concurrent with this holding operation, compressive receiving plates 3, 3 project above contents B.

Subsequently, after winding guides 2, 2 project a predetermined amount, in their approaching direction, elevator 1 is slightly raised, as shown in FIG. 4(*b*). The upper surface B3 of contents B engage with compressive receiving plates 3, 3 and, at the same time, contents B are immovably held between these mounting surface la and compressive receiving plates 3, 3. The contents B are compressed in a vertical direction, thereby, the portions of the packaging sheet opposing against both side surfaces B1, B1 of contents B are loosened in the vertical direction. Just after this operation, upstream side winding guide 2 projects out as shown in FIG. 4(*c*), and subsequently, downstream side winding guide 2 projects, as shown in FIG. 4(*d*).

With such an arrangement, each of extreme ends A1 and terminal end A2, of the packaging sheet, is wound and closely contacted in a U-shape along upper surfaces 2*a*, 2*a*, inner ends 2*b*, 2*b* of winding guides 2, 2 and resilient members 2*c*, 2*c*. The loosened portion of packaging sheet A, due to these frictional resistances, is pulled upwardly and fastened. Thereafter, if a slight raising of elevator 1, and the projection of winding guides 2, 2 are repeated, contents B are further metered in the vertical direction, and the packaging sheet is fastened.

Then, after the looseness of packaging sheet A is eliminated, as these winding guides 2, 2 project, a tension force applied to packaging sheet A is increased due to frictional resistance between packaging sheet A and winding guides 2, 2. Each of packaging sheets A are pulled out from between upper surfaces 2*a*, 2*a* of winding guides 2, 2 and sheet pressers 2*d*. The terminal end A2 of packaging sheet A is bent in advance along upper surface B3 of contents B, as shown in FIG. 4 (*c*).

Subsequently, extreme end A1 of packaging sheet A is also pulled out, as shown in FIG. 4(*d*). At this time, an adhering surface of adhering tape Cl adheres to the bottom surface of sheet pressers 2*d*, at the downstream end, and disposed to interfere with the passing position of pre-adhered adhering tape Cl, to cause the pulling-out of extreme end A1′ to stop. Thereby, packaging sheet A is further fastened, and then, the sheet is bent along upper surface B3 of contents B and, concurrently with this operation, bent terminal end A2′ and extreme end A1′, while being metered, push against upper surface B3 of contents B by resilient members 2*c*, 2*c*, thereby preventing removal of each of the ends.

Subsequent to this operation, as above, sheet pressers 2*d* move upwardly, as shown in FIG. 4(*e*). The downstream side winding guide 2 projects to the central upper positions of compressive receiving plates 3, 3, as shown in FIG. 4(*f*). The extreme end A1′ of packaging sheet A overlaps at the side of terminal end A2′. Concurrently with this operation, overlapped terminal end A2′, and extreme end A1′ are held by resilient member 2*c* at the lower surface of downstream side winding guide 2 and upper surface B3 of contents B. The projecting portions of adhering tapes C1, C2, C2, adhered to extreme end A1′ push against terminal end A2′, and adhering tapes Cl, C2, C2 adhere to both portions, and seal there.

Figure 5:
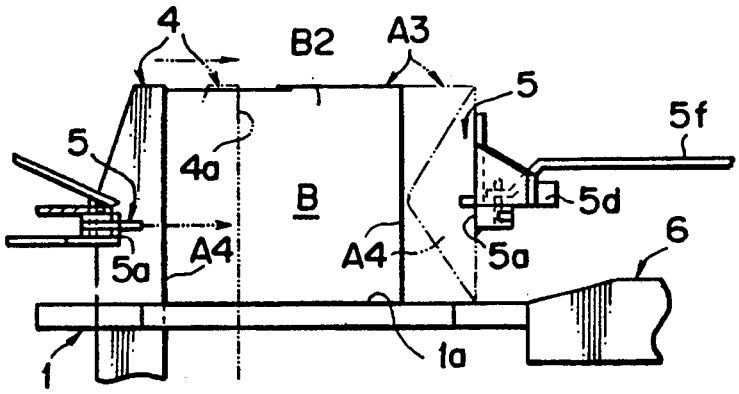
FIG. 5 is a partial enlarged front elevational view with a part being broken away to show the side flap folding start time.
Figure 6:
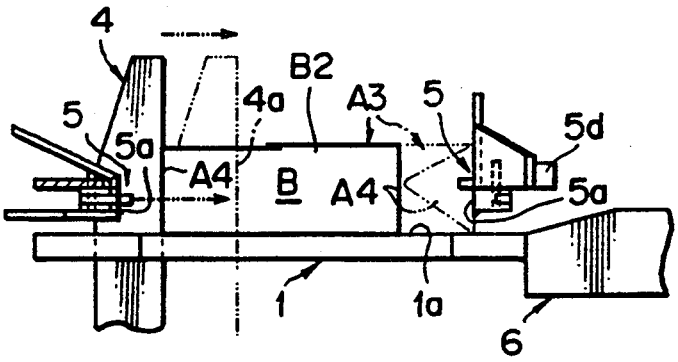
FIG. 6 is a partial front elevational view with a part being broken away to show when the extending end length is short.

Next, elevator 1 is slightly lowered, as shown in FIG. 4(*g*) to loosen the compression of contents B. Thereafter, compressive receiving plates 3, 3 are pulled out, and upon completion of the winding stage, in particular, in the case that an extending length of each of extending ends A3 is longer than a half of the width of each of opened side surfaces B2, contents B is lowered by a predetermined height by elevator 1, as shown in FIG. 5. In the case that the extending length of each of extending ends A3 is shorter than half of the width of each of opened side surfaces B2, contents B is raised, by a predetermined height, by elevator 1, as shown in FIG. 6.

Figure 7:
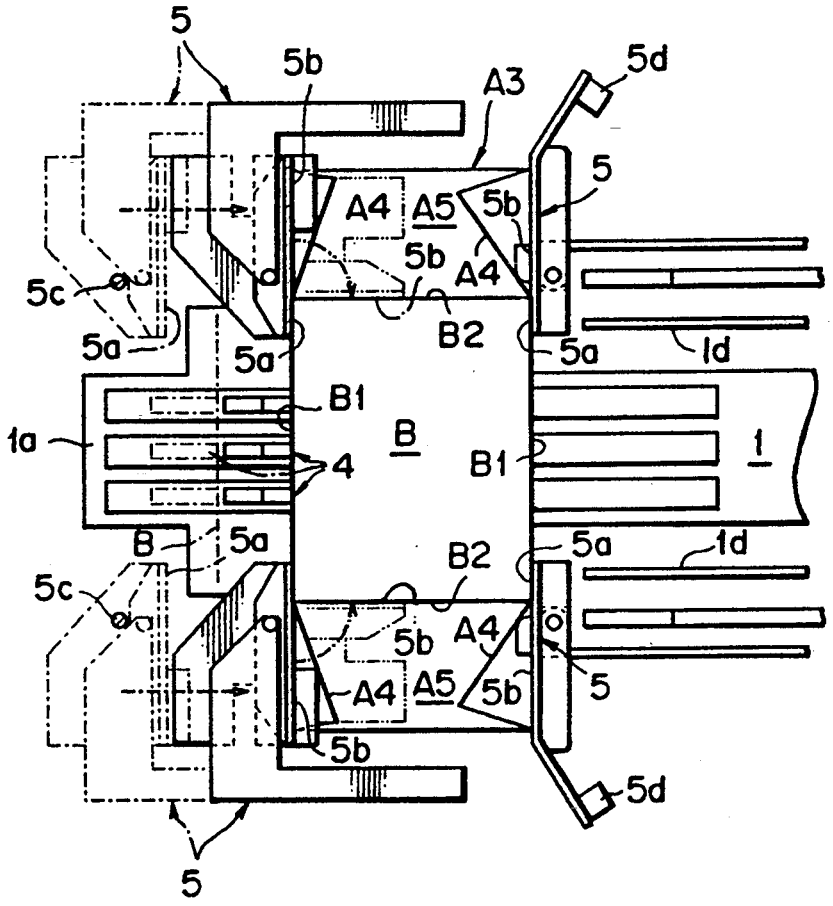
FIG. 7 is a partial enlarged cross sectional top plan view for showing the midway folding of the side flaps.

Then, contents B are transported by the advancing movement of transporting means 4. The closed downstream side surface B1 of contents B abuts against abutting portions 5*a*, 5*a* of downstream side lateral folding guides 5, 5, as shown in FIG. 7. At this time, contents B are removably held between temporary stopped transporting means 4 and downstream side abutting portions 5*a*, 5*a* are temporarily held by temporary holding portions 5*d*, 5*d* and the position of contents B is set.

Subsequently, the abutting portions 5*a*, 5*a* of advancing upstream side lateral folding guides 5, abut against winding closed upstream side surface B2 of each of contents B. Folding portions 5*b*, 5*b* lower toward lower flaps A5, A5 of extending end portions A3, A3, as each of the inner surface intermediate portions rotates by $\frac{1}{4}$ rotation, while rubbing the corners between upstream side surface B1 and opened side surfaces B2, B2. Thereby the entire upstream side flaps A4, A4 pull downwardly and are tightly bent along opened side surfaces B1, 'B2 of contents B while the base end upper portions of these side flaps A4, A4 are press contacted to the corners.

Figure 8:
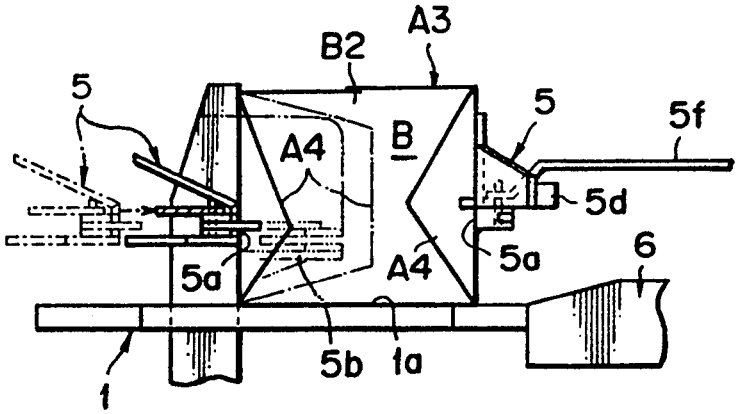
FIG. 8 is a partial front elevational view with a part being broken away for showing the side flap folding.
Figure 9:
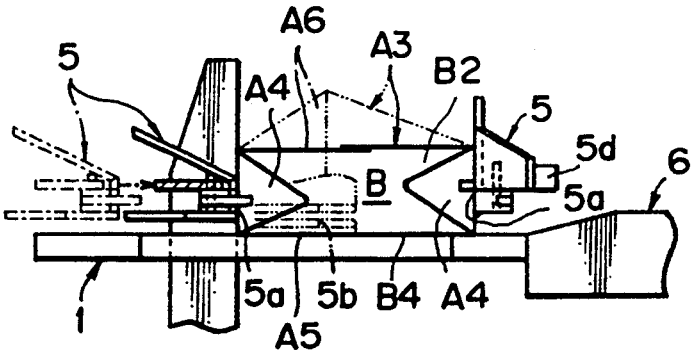
FIG. 9 is a partial front elevational view with a part being broken away to show when the extending length of the extending end is short.

At this time, in particular, when the extending length of each of extending ends A3 is longer than a half of the width of each of opened side surfaces B2, contents B are lowered by an amount substantially amount corresponding to the amount of folding portions 5*b*, 5*b* have been lowered before their folding operations. Thereby, folding portions 5*b*, 5*b* abut against the vertical intermediate positions of folded side flaps A4, as shown by a two-dotted line of FIG. 8. In the case that the extending length of each of extending ends A3 is shorter than half of the width of each of opened side surfaces B2, contents B are raised by the predetermined height before folding of upstream side flaps A4, A4. Thereby, the lower ends of folding portions 5*b*, 5*b* are lowered down to bottom surface B4 of contents B, as shown by a two-dotted line in FIG. 9, and then the folding line is applied.

Subsequently, contents B are transported again by transporting means 4. The folding portions 5*b*, 5*b* are lowered toward lower flaps A5, A5, as the inner surface intermediate portions of downstream side lateral folding sides 5, 5 are rotated by $\frac{1}{4}$ rotation, while rubbing the corners between downstream side surface B1 and opened side surfaces B2, B2. Thereby, the entire downstream side flaps A4, A4 are pulled downwardly, and the base end of the upper portions of side flaps A4, A4 are tightly folded, while being press contacted to the corners.

Figure 11:
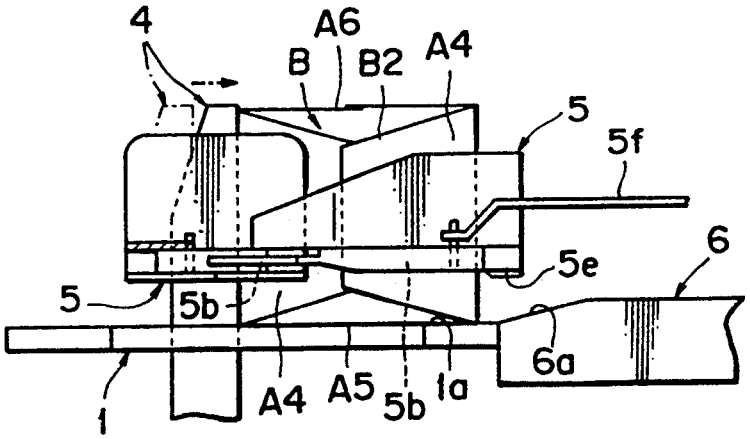
FIG. 11 is a partial front elevational view with a part being broken away to show the state of FIG. 10.

In particular, when the extending length of each of extending ends A3 is longer than half of the width of opened side surfaces B2, contents B is transported while upstream side lateral folding guides 2, 2 are stopped at the folding position. The vertical intermediate extreme ends of downstream side flaps A4, A4 overlap on the outside of the vertical intermediate extreme end of folded upstream side flaps A4, A4, as shown in FIG. 11. Concurrently with this operation, folding of both side ends of lower flaps A5, A5 and upper flaps A6, A6 stop in the middle and then each of them becomes a trapezoidal form and projects in a horizontal state.

Figure 12:
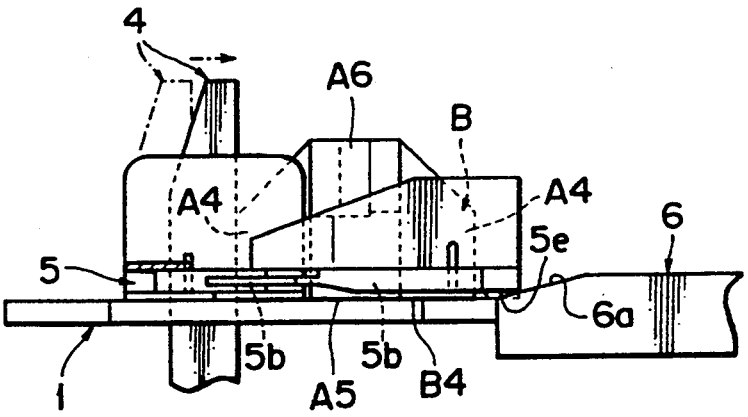
FIG. 12 is a partial front elevational view with a part being broken away to show when an extended length of the extending part is short.

In addition, when the extending length of each of extending ends A3 is shorter than half of the width of each of opened side surfaces B2, the lower ends of folding portions 5*b*, 5*b* lower to bottom surface B4 of contents B as shown in FIG. 12. The folding line is applied to the downstream end portions of lower flaps A5, A5 by the transportation of contents B formed by transporting means 4, as shown in FIG. 16(*a*).

Then, contents B pass between the inner surfaces of abutted and rotated lateral folding guides 5. The contents B are guided to the downstream side in the short length in the right and left direction of mounting surface 1*a*. The upper surfaces of suspending receiving tables 1*b*, 1*b* abut near the right and left ends of bottom surface B4 of contents B projecting from mounting surface 1*a* and supported by them. Thereby, the portions near the right and left ends of bottom surface 4 are prevented from being suspended. Concurrently with this operation, the base ends of lower flaps A5, A5 abut against upward inclined sides 6*a*, 6*a* of upper folding guides 6, 6 slightly higher than mounting surface la of elevator 1, and are folded up. Thereby, folded-up side flaps A4 are prevented from being loosened.

Figure 10:
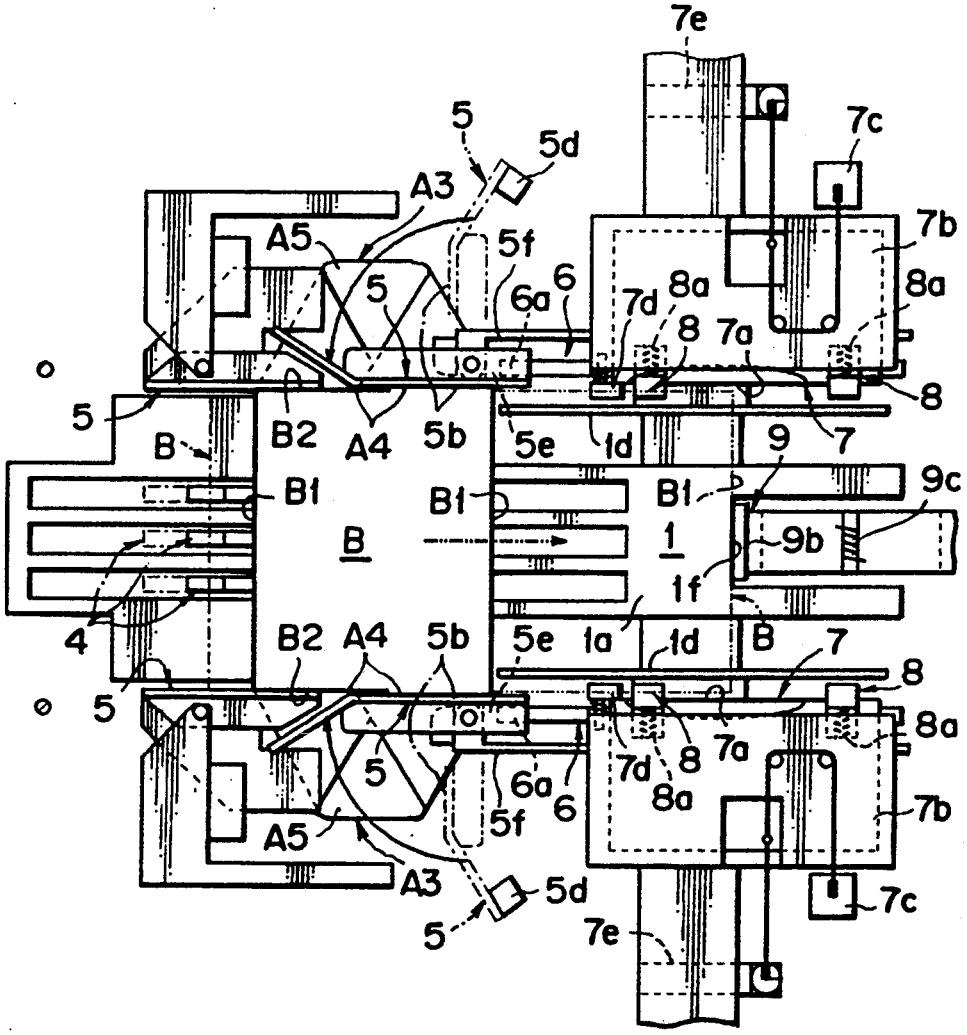
FIG. 10 is a partial enlarged cross sectional top plan view for showing the state just before completion of the folding of the side flaps.

Subsequently, closed downstream side surface B1 of contents B, transported by transporting means 4, abuts against rising piece 9*b* of latch 9, having a large projection delayed at the upstream end as shown by a two-dotted line in FIG. 10. It is transported to the downstream end while rising piece 9*b* is pressed against the closed downstream side surface B1, in the subsequent transportation. The contents B reach the predetermined position, and then the advancing movement of transporting means 4 is ended.

Figure 13:
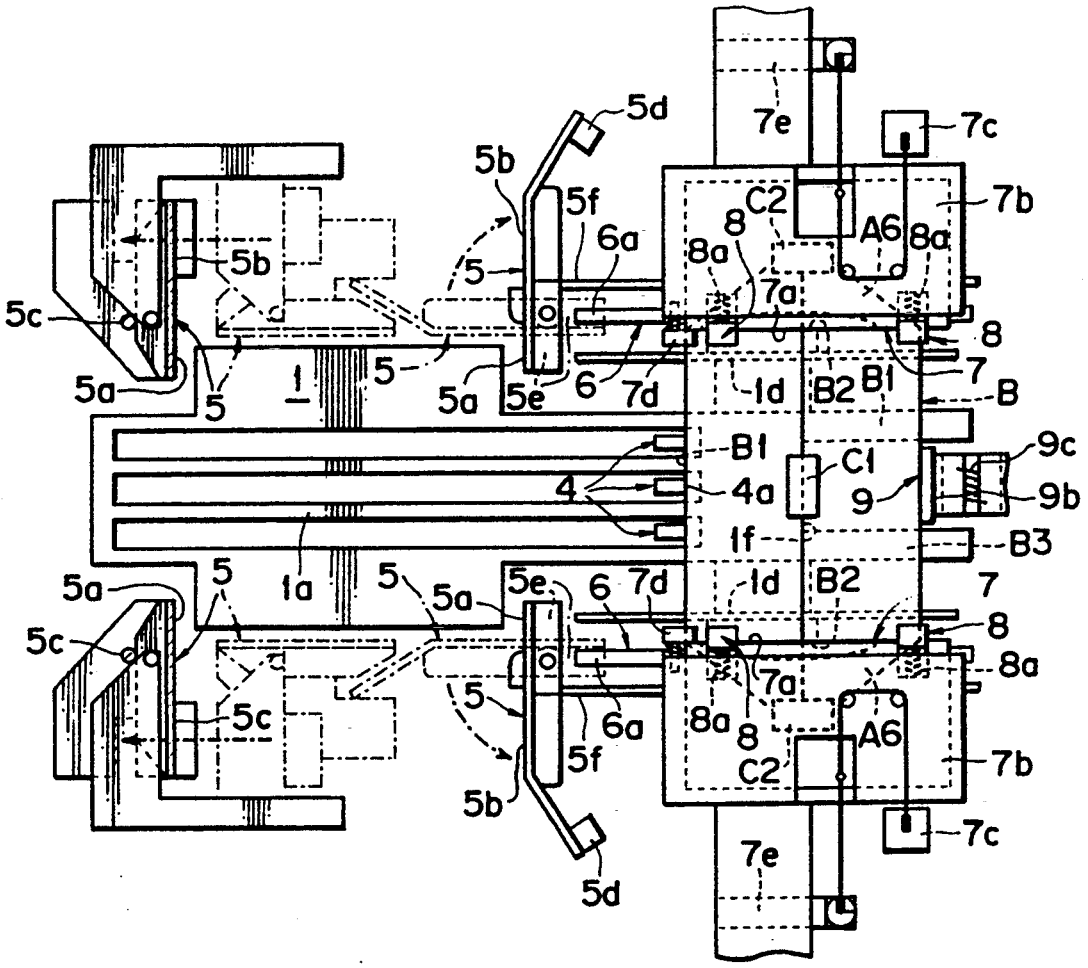
FIG. 13 is a partial enlarged cross sectional top plan view for showing the upper flap folding-down start state.

Substantially concurrent with this operation, upstream side lateral folding guides 5, 5 abut and engage with returning projections 5*c*, 5*c* in the middle of the retracting operation, as shown in FIG. 13. Thereby, upstream side lateral folding guides 5, 5 forcibly rotates in reverse, and return to their initial states. Subsequently, upper folding guides 6, 6 rise to fold up lower flaps A5, A5 outside of side flaps A4, A4, as shown in FIG. 6(*b*). In particular, when the vertical height of contents B is high, lower flaps A5, A5 fold up outside of side flaps A4, while keeping folded with pressing rods 5*f*, 5*f*. At same time, upper inclined sides 6*a*, 6*a* abut and engage with inclined cam surfaces 5*e*, 5*e* of downstream side lateral folding guides 5, 5. Thereby, downstream side lateral folding guides 5, 5 forcibly rotates, as shown in FIG. 13 and return to their initial states.

Figure 14:
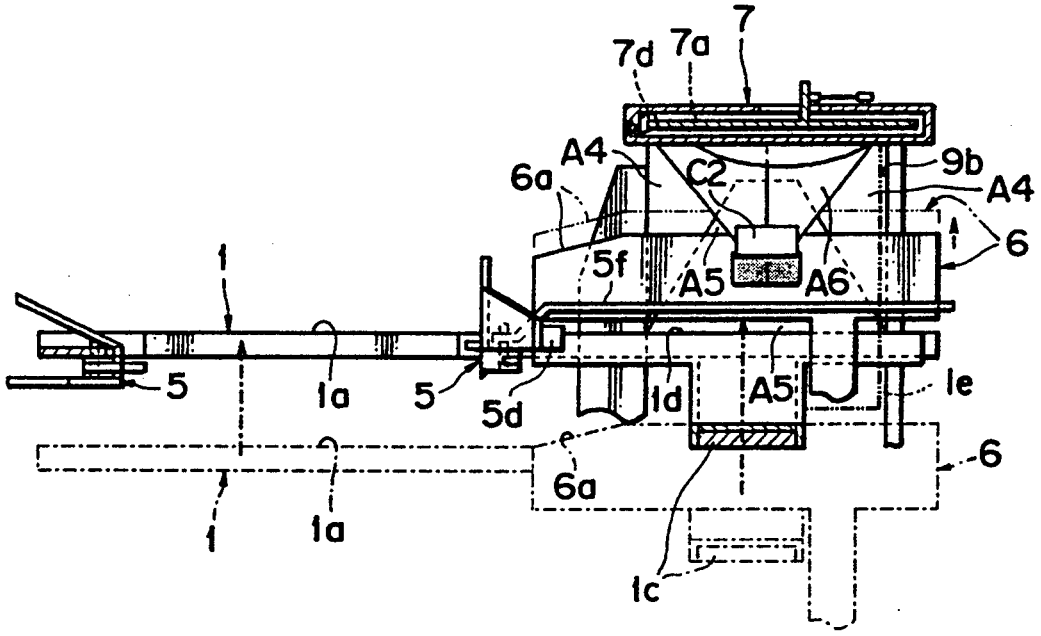
FIG. 14 is a partial front elevational view with a part being broken away to show the state of FIG. 13.
Figure 15:
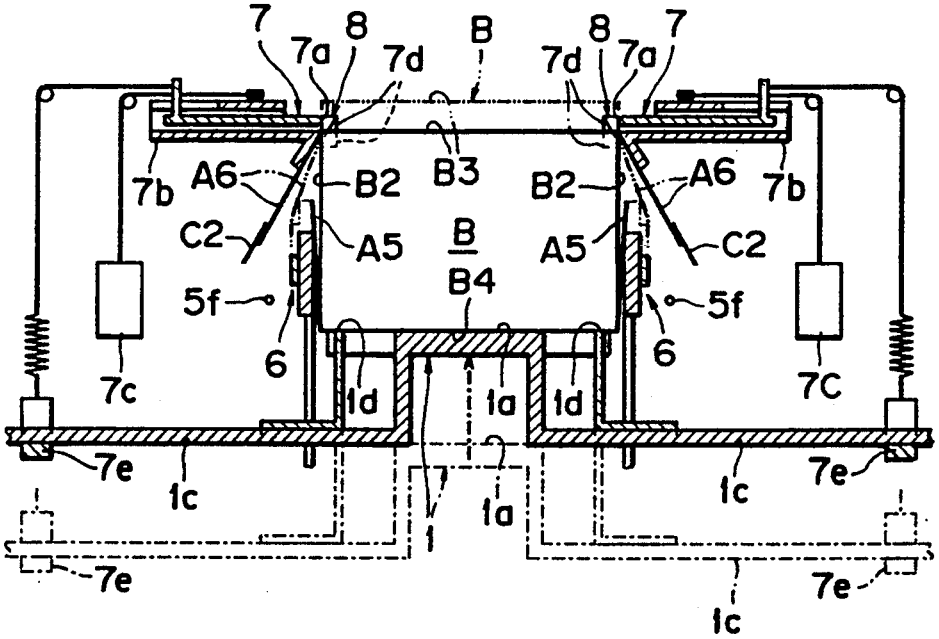
FIG. 15 is a longitudinal side elevational view in section to show the state of FIG. 13.
Figure 16C:
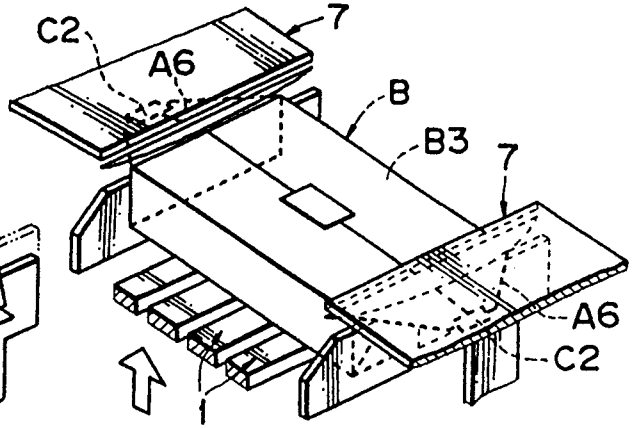
FIG. 16(*a*)–FIG. 16(*e*) are perspective views for showing the folding steps in sequence.
Figure 16B:
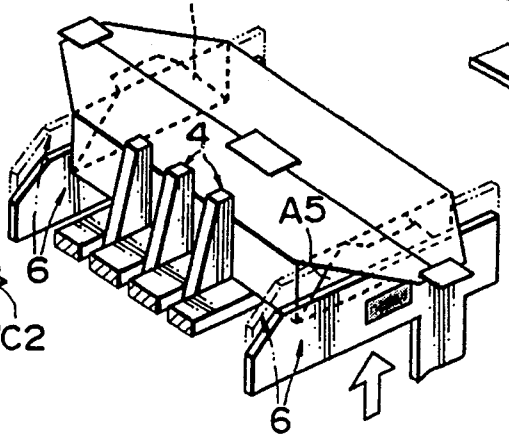
Figure 16A:
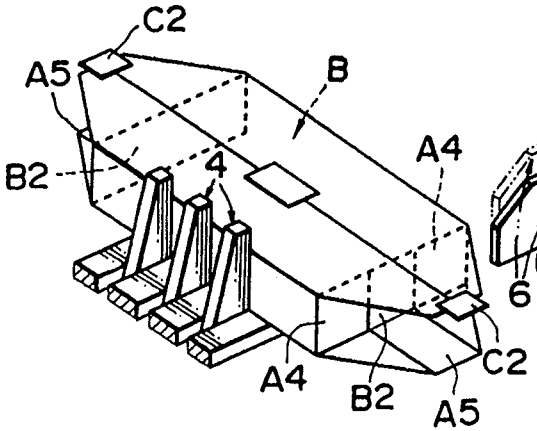
Figure 16E:
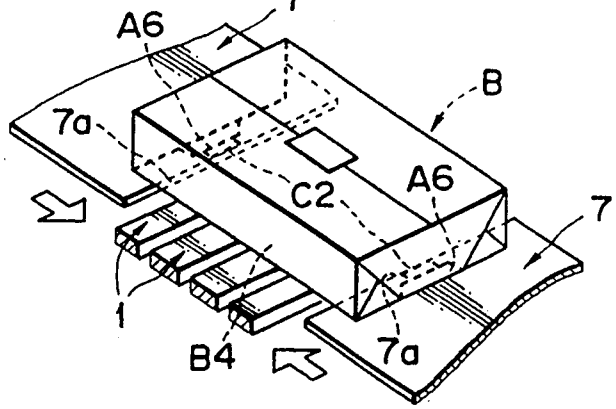
Figure 16D:
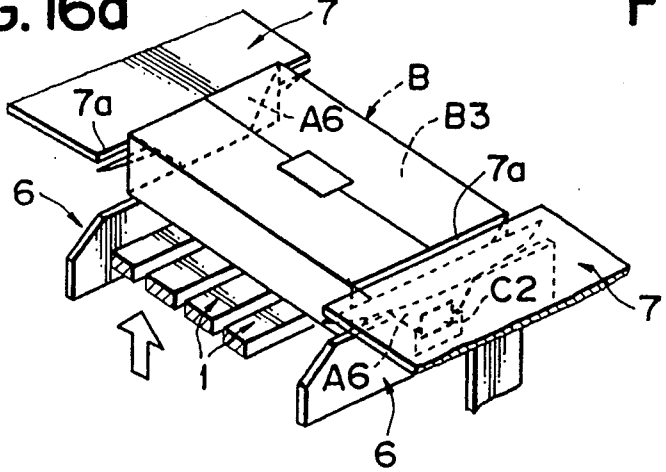

Subsequently, mounting surface 1*a* of elevator 1 and suspending receiving tables 1*d*, 1*d* rise to push up contents B, along advanced and stopped pushing surface 4*a*, the rising piece 9*b* of latch 9, having a large protection and raised upper folding guides 6, 6. When upper surface B3 of rising contents B abuts against stoppers 7*d*, 7*d* of folding guides 7, 7, inner ends 7*a*, 7*a* of folding guides 7, 7, pushed by weights 7*c*, 7*c*, at the specified pressure against opened side surfaces B2, B2 of contents B, as shown by the solid line in FIGS. 14, 15 and 16(*g*).

With such an arrangement as above, upper flaps A6, A6 gradually fold down while rubbing downwardly, as shown in FIG. 16(*d*), overlapping on the outside of lower flaps A5, A5. When the projection, length of upper flaps A6, A6 is shorter than the height of contents B as shown in FIG. 1, adhering tapes C2, C2 adhere to extreme ends of upper flaps A6, A6, while tensioned downwardly by inner ends 7*a*, 7*a* of folding guides 7, 7, and then to lower flaps A5, A5. Thereby, the flaps are sealed and the folding stage is completed.

In addition, when the projecting length of upper flaps A6, A6 is longer than the height of contents B and the extreme ends of upper flaps A6, A6 project downwardly from bottom surface B4 of contents B upon completion of folding-down operation, inner ends 7*a*, 7*a* of folding guides 7, 7 project along bottom surface B4 of contents B by weights 7*c*, 7*c*, when the raising of contents B completes its passing operation between inner ends 7*a*, 7*a* of folding guides 7, 7. Thereby, latches 8, having a small projection, project along right and left ends of bottom surface B4, and further, rising piece 9*b* of latch 9 having a large projection also projects up to nearly the central part along bottom surface B4.

After contents B are supported by latches 8, 9, mounting surface 1*a* of elevator 1 lowers, resulting in inner ends 7*a*, 7*a* of folding guides 7, 7 projecting by weights 7*c*, 7*c*, as shown in FIG. 16(*e*). The extreme ends of upper flaps A6, A6 fold along bottom surface B4 of contents B, and concurrently with this operation, they adhere by adhering tapes C2, C2 adhered at their extreme ends, and then they are sealed.

Contents B, of which the foldings are completed, is supported by latches 8, 9 even if the next contents B starts to perform the packaging operation. Elevator 1 starts to lower, and folding guides 7, 7 move in a direction away from each other. This results in contents B not lowering and contents B, with its packaging completed, are not removed. The next contents B is packaged, and these contents B overlap on latches 8.

In addition, when the size of each of packaging sheets A is changed, control part automatically changes the feeding amount of packaging sheet A, with sheet feeding-out means 23, in response to size inputted data.

When outer shape and size of contents B are changed and its height is changed, the control part automatically changes the feeding-out amount of packaging sheet A by sheet feeding-out means 23, the amount elevator 1 is lowered and the height positions of upper folding guides 6, 6. In turn, when the width of contents B is changed, the control part automatically changes the feeding-out amount of packaging sheet A, by sheet feeding-out means 23. The control part moves each of reference guides 10 and winding guides 2, 2 to the sheet supplying direction, and automatically changes these spacings. When the length size of contents B is changed, the control part moves each of upper folding guides 6, 6, and folding guides 7, 7 in the right and left direction and automatically changes spacings.

In the aforesaid preferred embodiment, one sheet of accumulated packaging sheets A is separated and supplied onto elevator 1. This is not limited to this operation. The rolled up packaging sheet is cut to a predetermined length and it may be supplied to elevator 1.

Figures 17A, 17B, 17C, 17D, 17E, 17F:
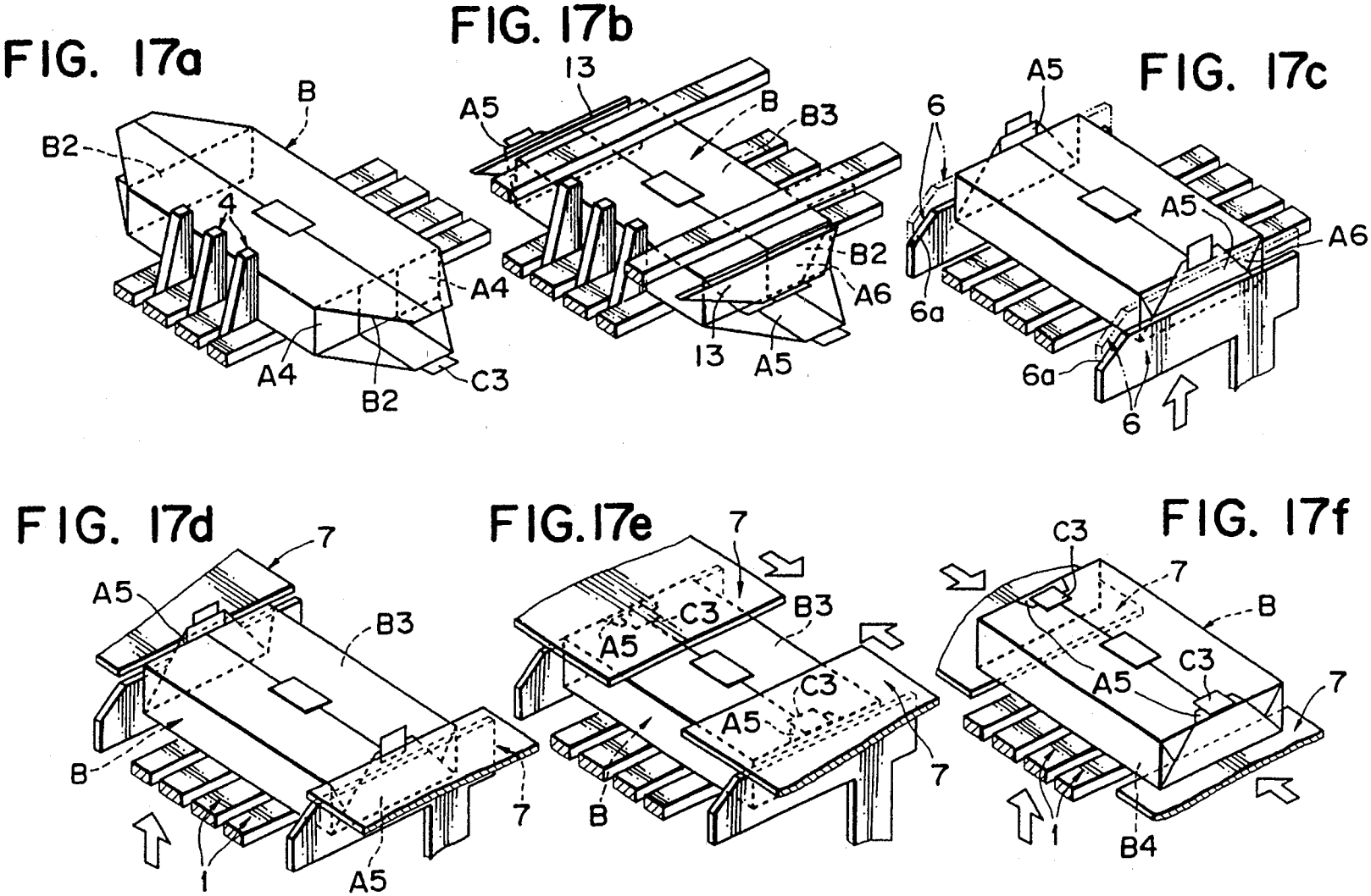
FIG. 17(*a*)–FIG. 17(*f*) are perspective views for showing an example of modification of the folding steps in sequence.

In addition, after lower flaps A5, A5 are folded up, upper flaps A6, A6 are folded by raising contents B with elevator 1, and overlapped on the outside of lower flaps A5, A5. The present invention is not limited to this operation. For example, as shown in FIG. 17, after upper flaps A6, A6 are folded down by folding-down guides 13, 13, arranged between the downstream side lateral folding guides 5, 5 and upper folding guides 6, 6, lower flaps A5, A5 are folded up by upper folding guides 6, 6 and overlapped on them. Thereby, the extreme ends of lower flaps A5, A5 may be sealed by adhering tapes adhered in advance. The extreme ends of folded-up lower flaps A5, A5 may be folded along upper surface B3 of contents B through the projecting-out movement of folding guides 7, 7, and they may be sealed by adhering tapes C3, C3 adhered in advance.

Since present invention is constructed as described above, it has following advantages.

After the elevator lowers, compressive receiving plates project above the contents. Thereafter, the elevator rises to cause the contents to be held between compressive receiving plates. The contents are compressed in a vertical direction, and winding guides approach and move toward the contents while the contents are being compressed. Both ends of the packaging sheet are connected by fixing means, and subsequently the compressive receiving plates are pulled out, resulting in that the contents, which can be compressed in vertical direction, can be tightly wound.

Accordingly, as compared with prior art device, in which the packaging sheet is wound around the contents, and one end of the packaging sheet is moved and fastened to the contents, collapsing of the contents or occurrence of wrinkles in the packaging sheet can be prevented. The contents can be protected without any damage due to fact that packed products are piled up after completion of packaging, and even if a load is applied onto the packed products, the packed products are hardly compressed more than the applied load.

After both ends of the packaging sheet are connected, the elevator is slightly lowered. Thereby, the compression of contents is loosened, and the compressive receiving plates are moved out of the raising or lowering passage while the compression is loosened. The compressive receiving plates may easily be pulled out from the tightly wound contents.

After the packaging sheet is folded into a substantially U-shape, each of the sheet pressers abuts against the upper surface of the winding guide and both ends of the packaging sheet are held. Thereafter, the winding guides move in the direction in which they may approach along surface of the lowered contents. Thereby, each of both ends of the packaging sheet is wound in a U-shape and closely contacted to the upper and lower surfaces and inner ends of the winding guides. The packaging sheet is highly tensioned by frictional resistance, resulting in that the packaging sheet can be tightly fastened.

Accordingly, as compared with prior art device in which the packaging sheet is fastened through the frictional resistance generated by abutment between the lower end of the frictional rotary member and the packaging sheet, the abutment area with the packaging sheet can be increased. The frictional resistance is also increased and, further, the packaging sheet can be tightly wound.

As the winding guides approach and move from each other, the tension force applied to the packaging sheet is higher than the frictional resistance with the winding guides. Thereby, the packaging sheet is pulled out from between the upper surface of the winding guides and the sheet pressers. At the same time, the adhering surfaces of the adhering tapes adhere to the sheet pressers during the pulling-out operation. The pulling-out operation is stopped and the packaging sheet is further highly tensioned, so that the packaging sheet can be strongly fastened.

The contents pass between the spaced-apart winding guides and lowers from the packaging start position, under operation of the elevator. Thereby, both ends of the packaging sheet are folded into a substantial U-shape. Thereafter, these winding guides are moved in the direction in which they approach each other along the upper surface of the lowered contents.

Thereby, both ends of the packaging sheet are folded along the upper surface of the contents to complete the winding step. The wound contents are transported horizontally along the mounting surface of the lowered elevator, and at same time, each of the extending ends is folded by the folding means, while the contents is sent and transported by the elevator to the packaging completing position. Thereby, the packaging sheet and the contents are transported in a substantial U-shape. The adjoining packaging start position and packaging completing position are closely arranged at the same height positions, so that packaging sheet is not delayed, and the packaging start position and packaging completing position can be approached as close as possible.

Accordingly, as compared with prior art device, in which the packaging start position and the packaging completing position are moved away in the vertical and horizontal direction the transporting passage for the contents can be shortened in the horizontal transporting direction. Correspondingly, an entire device can be reduced in size, and at same time, in the case that the contents are manually mounted at the packaging start position by one worker, and another operation for lowering the packaged contents from packaging the completing position, are alternatively carried out, the amount of worker moves is reduced. The worker can easily form a mass-production process and so its convenience in use can be improved.

The packaging sheet is supplied to the packaging start position. Thereby, part of the packaging sheet projecting from the contents to the packaging completing position is held while being bent upwardly along the winding passage. The projecting amount of the packaging sheet from the packaging start position to the packaging completing position is shortened, so that the packaging start position and packaging completing position can approach each other.

What is claimed is:

1. A method for packaging comprising the steps of:

supplying a packaging sheet onto a mounting surface of an elevator at a packaging start position;

placing contents on the packaging sheet at the packaging start position;

lowering the elevator;

moving a plurality of compressive receiving plates above said contents;

winding the packaging sheet, with a pair of winding guides by moving said winding guides toward each other and toward a central axis of said contents, said central axis being located between said winding guides, in a tubular form around the contents whereby the ends of the packaging sheet project in a rectangular cylindrical form from the side surfaces of the contents;

transporting the contents horizontally to a packaging completing position; and folding the projected ends of the packaging sheet along the side surfaces.

2. The method according to claim 1, further comprising:

partially bending the packaging sheet between the packaging start position and the packaging completing position.

3. The method according to claim 2, further comprising;

supplying the packaging sheet along a lower bent feeding-out passage.

4. A method of packaging comprising the steps of:

supplying a packaging sheet onto an elevator at a packaging start position;

placing the contents to be packaged on a packaging sheet;

lowering the elevator thereby folding the packaging sheet into a substantial U-shape along a bottom surface of the contents;

moving compressive receiving plates above the upper surface of the contents;

moving a plurality of guides toward a central axis of said contents to bring the ends of said packaging sheet adjacent each other; and raising the elevator.

5. The method according to claim 4, further comprising:

moving a plurality of winding guides to connect the ends of the packaging sheet;

lowering the elevator; and moving the compressive receiving plates away from the contents.

6. The method according to claim 5, whereby the ends of the packaging sheets are connected by adhesive tapes.

7. The method according to claim 5, further comprising:

horizontally transporting the contents along a mounting surface;

raising the contents to a packaging completing position;

folding the ends of the packaging sheet along the side surfaces of the contents between the time the contents are horizontally transported and the contents are raised to the packaging completing position.

8. The method according to claim 7, wherein a guiding passage partially bends and holds the packaging sheet between the packaging start position and the packaging completing position.

9. The method according to claim 4, wherein the packaging sheet is supplied to the packaging start position by a lower bent feeding out passage.

10. A packaging device for packaging contents of substantial rectangular shape by placing the contents above a packaging sheet supplied on an elevator, the packaging sheet and the contents being lowered from a packaging start position by the lowering of the elevator at the packaging start position, the packaging sheet being wound in a tubular form around the contents, the wound contents being horizontally transported by the transporting means to a packaging completing position, each of the extending ends of the packaging sheet, projecting in a rectangular cylindrical form from the opened side surface of said contents, being folded along the opened surface, said packaging device comprising:

an elevator including a mounting surface;

a pair of winding guides abutting against both ends of the packaging sheet folded in a substantial U-shape at the bottom surface of the contents and including opposing side surfaces reciprocally arranged to move toward and away from each other along the upper surface of the contents;

said winding guides also being arranged such that each of said winding guides is moveable toward a central axis of said contents, said axis being located between said winding guides;

said compressive receiving plates and said winding guides being separately movable with respect to each other, such that said winding guides are arranged to wind said packaging sheet around said contents while said compressive receiving plates compress said contents;

transporting means for horizontally transporting the wound contents along the mounting surface of the elevator, from the packaging start position to the packaging completing position; and folding means for folding each of extending ends of the wound packaging sheet along the opened side surface of the contents.

11. The packaging apparatus according to claim 11, further comprising:

a guiding passage for partially upwardly bending the supplied packaging sheet and folding it between the packaging start position and the packaging completing position.

12. The packaging apparatus according to claim 11, further comprising a lower bent feeding-out passage, and wherein the packaging sheet is supplied to the packaging start position along said lower bent feeding-out passage.

13. A packaging apparatus in which a contents of substantial rectangular shape is placed above a packaging sheet supplied onto an elevator, the packaging sheet being folded into a substantial U-shape along a bottom surface of the contents and both opposing side surfaces of the contents from a packaging start position during lowering of the elevator, and both ends of the packaging sheet being folded along an upper surface of the contents, said apparatus comprising:

an elevator including a raising and lowering passage;

a plurality of winding guides, including inner winding guides, reciprocally arranged between a supplying position of the packaging sheet and said elevator, said inner winding guides being movable toward and away from each other along an upper surface of the lowered contents, wherein said inner winding guides include inner ends arranged near the opposing both side surfaces of the contents;

said winding guides also being arranged such that each of said winding guides is moveable toward a central axis of said contents, said axis being located between said winding guides;

compressive receiving plates arranged between said winding guides and the upper surface of the lowered contents in such a manner that they may be fed in and out of said raising or lowering passage of said elevator when said elevator is lowered, whereby said elevator raises when said compressive receiving plates are projected and opposed against the upper surface of the contents;

said compressive receiving plates and said winding guides being separately movable with respect to each other, such that said winding guides are arranged to wind said packaging sheet around said contents while said compressive receiving plates compress said contents; and fixing means; wherein said winding guides are movable so that both ends of the packaging sheet are connected by said fixing means.

14. The packaging apparatus according to claim 13, wherein after said winding guides approach and move toward each other, and both ends of the packaging sheet are connected, said elevator slightly lowers, and said compressive receiving plates move out of said raising or lowering passage.

15. The packaging apparatus according to claim 13, further comprising:

means for horizontally transporting the wound contents along said mounting surface of said lowered elevator, wherein the contents are raised and transported to the packaging completing position adjacent to the packaging start position; and means for folding each of extending ends of the wound packaging sheet along an opened side surface of the contents during a time from the horizontal transportation of the contents by said transporting means to a raising transportation by said elevator; and wherein each of the extending ends of the packaging sheet project from the opened side surface of the wound contents in a rectangular cylindrical form and are folded along the opened side surface.

16. The packaging apparatus according to claim 13, further comprising:

a guiding passage between the packaging start position and the packaging completing position for partially bending upwardly and holding the packaging sheet.,

17. The packaging apparatus according to claim 16, further comprising a lower bent feeding out passage for supplying the packaging sheet to the packaging start position.

18. The packaging apparatus according to claim 13, wherein said winding guides include an upper surface, and said packaging apparatus further comprises:

a plurality of sheet pressers reciprocally arranged above the packaging sheet supplying position, and movable toward and away from said upper surface of said winding guides

19. The packaging apparatus according to claim 18, wherein said fixing means comprises adhesive tapes, said adhesive tapes being partially projected in the winding direction and adhered to one end of the packaging sheet in its winding direction; and said sheet pressers being arranged above the adhering tape supplying passing position and the adhering surface of said fixing means, and facing opposite each other.

* * * * *